US011479032B2

(12) United States Patent
De Gaillande et al.

(10) Patent No.: US 11,479,032 B2
(45) Date of Patent: Oct. 25, 2022

(54) PLATEN PRESS WITH A PRESS TOGGLE MECHANISM

(71) Applicant: BOBST MEX SA, Mex (CH)

(72) Inventors: Christophe De Gaillande, Les Monts-de-Corsier (CH); Guy Delaloye, Lonay (CH); Steven Stojanovic-Roth, Nax (CH); Lukas Tiller, Epalinges (CH)

(73) Assignee: BOBST MEX SA, Mex (CH)

( * ) Notice: Subject to any disclaimer, the term of this patent is extended or adjusted under 35 U.S.C. 154(b) by 0 days.

(21) Appl. No.: 17/595,692

(22) PCT Filed: May 26, 2020

(86) PCT No.: PCT/EP2020/064522
§ 371 (c)(1),
(2) Date: Nov. 22, 2021

(87) PCT Pub. No.: WO2020/239736
PCT Pub. Date: Dec. 3, 2020

(65) Prior Publication Data

US 2022/0203669 A1 Jun. 30, 2022

(30) Foreign Application Priority Data

May 27, 2019 (EP) ..... 19020346

(51) Int. Cl.
*B41F 16/00* (2006.01)
*B26D 5/18* (2006.01)
*B26F 1/40* (2006.01)

(52) U.S. Cl.
CPC ..... *B41F 16/0046* (2013.01); *B26D 5/18* (2013.01); *B26F 1/40* (2013.01); *B41P 2219/13* (2013.01)

(58) Field of Classification Search
CPC ..... B41F 16/0046; B26D 5/18; B26D 5/08; B26D 5/16; B26F 1/40; B26F 2001/4409;
(Continued)

(56) References Cited

U.S. PATENT DOCUMENTS 2,258,880 A * 10/1941 Bobst ..... B26D 5/10 271/7
3,182,588 A 5/1965 Edwin
(Continued)

FOREIGN PATENT DOCUMENTS

CN 2573216 Y 9/2003
CN 201669903 U 12/2010
(Continued)

OTHER PUBLICATIONS

International Search Report issued in International Application No. PCT/EP2020/064522 dated Jul. 22, 2020 (3 pages).

*Primary Examiner* — Jonathan G Riley
(74) *Attorney, Agent, or Firm* — Bookoff McAndrews, PLLC

(57) ABSTRACT

A platen press with a press toggle mechanism (43) having a driving member (14) and a press toggle column (44). The press toggle column (44) comprises a driven member (38), a first toggle lever (46) assigned to the driven member (38) and a second toggle lever (48) assigned to the driven member (38). The first toggle lever (46) has a first contact surface (50) and the second toggle lever (48) has a second contact surface (52). Both toggle levers (46, 48) contact each other via their contact surfaces (50, 52), and wherein both contact surfaces (50, 52) are convex-shaped.

20 Claims, 5 Drawing Sheets

Figure 1:
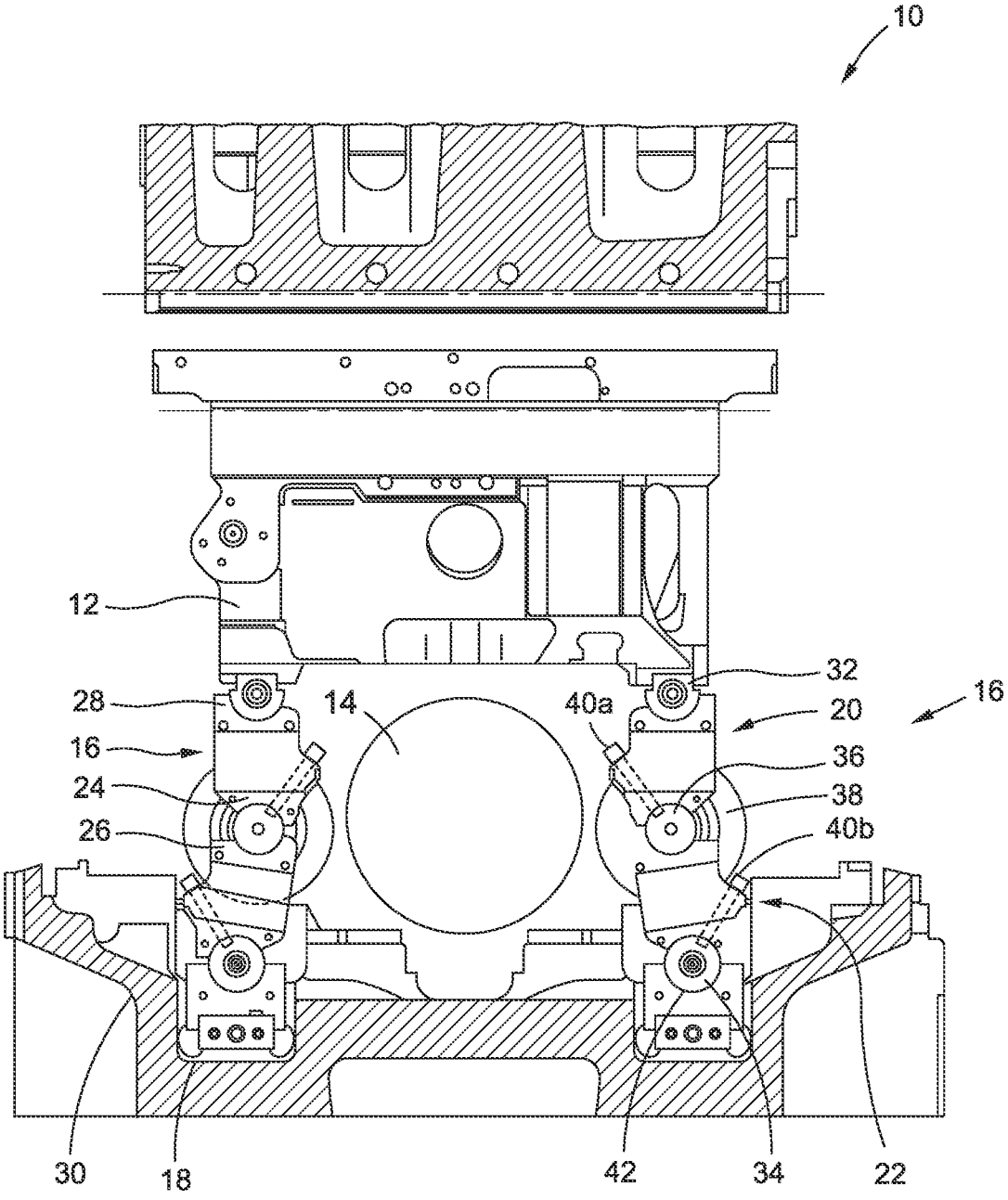

(58) Field of Classification Search
CPC ..... B41P 2219/13; B30B 1/008; B30B 1/14; B30B 1/261; B31B 50/142; B31B 50/20; Y10T 83/8843; B25B 1/106; F16H 25/183
See application file for complete search history.

(56) References Cited

U.S. PATENT DOCUMENTS 4,044,623 A * 8/1977 Preisenhammer .... F16H 25/183 74/520
4,419,929 A * 12/1983 Dommer ..... B30B 1/106 100/286
4,466,318 A * 8/1984 Schoch ..... B30B 15/281 83/277
4,485,708 A * 12/1984 Halff ..... B30B 1/261 83/624
4,852,382 A * 8/1989 Gietz ..... B26F 1/40 100/286
4,920,782 A * 5/1990 Hellwig ..... G03C 1/00 72/445
4,967,586 A * 11/1990 Hecht ..... B30B 1/14 72/352
5,176,075 A * 1/1993 Vegue ..... B21J 9/18 100/282
5,467,706 A * 11/1995 Kato ..... B30B 1/14 100/282
5,575,202 A 11/1996 Pfeiffer
5,687,645 A * 11/1997 Kato ..... B30B 1/261 100/282
6,510,786 B1 * 1/2003 Harsch ..... B30B 1/16 100/286
10,293,416 B2 * 5/2019 Huang ..... B23D 15/08
2004/0103799 A1 * 6/2004 Liu ..... B30B 1/14 101/28

FOREIGN PATENT DOCUMENTS

| | | | |
|---|---|---|---|
| CN | 103118873 | A | 5/2013 |
| DE | 942554 | C | 5/1956 |
| GB | 2396581 | A | 6/2004 |
| JP | 49-113973 | A | 10/1974 |
| JP | 2001062600 | A | 3/2001 |
| JP | 2010279999 | A | 12/2010 |
| TW | I551429 | B | 10/2016 |

* cited by examiner

PLATEN PRESS WITH A PRESS TOGGLE MECHANISM

CROSS-REFERENCE TO RELATED APPLICATION(S)

This application is a National Stage under 35 U.S.C. § 371 of International Application No. PCT/EP2020/064522, filed May 26, 2020, which claims priority to European Application No. 19020346.3, filed May 27, 2019, the entireties of which are incorporated herein by reference.

The invention relates to a platen press with a press toggle mechanism.

Drive devices for use in a stamping station, particularly a hot foil stamping station, or a cutting station of a platen press typically operate by means of a driving member and a toggle column. The toggle column may generally have a driven member, for instance a cam roller, a connecting rod or the like, that interacts with the driving member, for instance a cam of a camshaft or a crankpin of a crankshaft or the like. In fact, the cam or rather the crankpin relates to the driving member that drives the driven member.

The driving member and the toggle column establish a so-called toggle mechanism that corresponds to a movable hinge. Therefore, the toggle column typically comprises two toggle levers, namely an upper one and a lower one, connected with each other in a displaceable manner ensuring a relative motion between both toggle levers such that the movable hinge is formed.

In the state of the art, the driven member and the toggle levers of the press toggle column are commonly connected via a center axle together forming the movable hinge. In this hinge, the surfaces of the toggle levers are in sliding contact with the surface of the center axle. However, there is a risk of seizure or rather wear on the contact surfaces that are in sliding contact. In the state of the art, many parameters and processes are considered for minimizing this risk. However, this results in high efforts when designing the respective toggle mechanism. For instance, a pressure-velocity factor is a design parameter that is tried to be kept as low as possible in the design phase. Moreover, lubrication under pressure is used to decrease the friction between the contact surfaces and to dissipate occurring heat. In addition, the contact surfaces are hand scraped to ensure a rapid and even distribution of the lubricant. In fact, the scraped contact surfaces allow an elastohydrodynamic behavior of the lubricant.

However, under high loading and at high cadence, namely a high processing frequency of the press toggle mechanism, it becomes difficult to assess a press toggle design only based on the pressure-velocity factor since other unknown factors have to be considered. Moreover, the lubrication mechanism is not totally understood and the contact surface scraping involves repeatability issues depending on the knowhow of a skilled person. In summary, it is very difficult to ensure a low risk of wear or seizure for press toggle columns and press toggle mechanisms.

DE 942 554 C shows a platen press according to the preamble of claim 1.

Therefore, it is an object of the invention to provide a press toggle column and a press toggle mechanism that reduce the risk of wear or rather seizure.

The invention provides a platen press with a press toggle mechanism, wherein the press toggle mechanism has a driving member and a press toggle column with a driven member and a first toggle lever assigned to the driven member and a second toggle lever assigned to the driven member. The first toggle lever has a first contact surface and the second toggle lever has a second contact surface, wherein both toggle levers contact each other via their contact surfaces, and wherein both contact surfaces are convex-shaped.

Because of the convex-shaped contact surfaces of the toggle levers the sliding motion between the contact surfaces is replaced by a (pure) rolling motion or a combined rolling/sliding motion, reducing the friction between the contact surfaces and thus the risk of wear or rather seizure. Therefore, lubrication is (almost) no longer an issue and the hand scrapping of the contact surfaces can be omitted (almost completely). Obviously, many other advantages arise from this design of the press toggle column such as an increased efficiency and/or cost savings.

In fact, the contact surfaces face a common center of the press toggle column. Hence, the contact surfaces may be assigned to ends of the respective toggle lever, which face towards the center.

The convex-shaped contact surfaces are located at ends of the respective toggle lever so that the surfaces of these ends, namely the contact surfaces, are convex, seen from the respective toggle lever towards its end.

In other words, a middle portion of the contact surface may be distanced by a larger distance from a center plane of the respective toggle lever than the end portions of the contact surface due to the curvature of the contact surface.

Put it another way, the contact surface of each toggle lever may be at least partially circular wherein the fictive center points of the convex-shaped contact surfaces are located at opposite sides of the contact area defined by both contact surfaces.

Particularly, each of the contact surfaces is shaped like a condyle or rather condyle-like. In general, a condyle relates to a joint head, as it is an essentially round end portion of a bone that is most often part of a joint. For instance, the condyle is assigned to the femur and the tibia in a human knee joint. Further, a condyle is provided by the humerus in a human elbow joint.

In a preferred embodiment, any sliding motion between the toggle levers is avoided so that only a pure rolling motion occurs between both toggle levers reducing the friction between both contact surfaces maximally.

In any case, a rolling motion is added to the sliding motion so that a pure sliding motion is prohibited. Hence, sliding is reduced in either case as a rolling occurs.

The rolling takes place in the contact area or rather contact zone in which both contact surfaces contact each other.

According to an embodiment, the toggle levers together form a movable hinge that provides at least a rolling motion between the contact surfaces. That essentially allows the mechanism or movement sequence of the conventional press toggle column to be transferred to the press toggle column.

According to an embodiment, the driven member is connected with the first toggle lever. The driven member may be in continuous contact with the driving member, for instance a cam of a camshaft, that might be formed eccentrically or rather its shape differs from a round one. The driven member may therefore relate to a cam roller. However, the driven member may also be in continuous contact with a driving member established by a crankpin of a crankshaft. Hence, the driven member may relate to a connecting rod. In general, it is possible to transfer the rotational motion of the driving member to the press toggle column, in particular with a certain frequency, to obtain the respective cadence.

According to a further embodiment, each of the toggle levers has a linkage end that is opposite to the respective contact surface. For example, the linkage ends can be used to attach the corresponding toggle levers to certain structures. Particularly, the structures comprise at least one base structure (e.g. pad) or at least one moveable structure (e.g. plate) of the platen press.

An embodiment provides that the linkage end of each toggle lever is convex-shaped. Therefore, the sliding motion between the linkage end of the toggle lever and, for example, a structure connected thereto can be replaced by a (pure) rolling motion or a combined rolling/sliding motion with the above stated advantages.

In an embodiment, the toggle lever is formed by at least two separate parts. Each of the convex contact surfaces and/or convex linkage ends may be formed by a respective interface part, which is fixed to a respective end of a main body of the toggle lever, for instance by a screw, a bolt and/or a pin. The main body corresponds to another separate part of the toggle lever.

Hence, each toggle lever may comprise three different parts, namely the main body having two opposite ends, each of which is fixed to one respective interface part that has the convex contact surfaces or rather the convex linkage ends.

For example, the convex contact surfaces and the convex linkage ends of the respective toggle levers are formed by (at least partially) circularly cylindrical axles firmly connected to the toggle levers, for instance via screws, bolts and/or pins.

Optionally, the at least one interface part, particularly both interface parts, protrudes from the press toggle column with respect to the main body, thus forming at least one protruding section, particularly two protruding sections at opposite ends of the toggle lever.

In a further embodiment, a repeatability device is provided that is operatively connected with both toggle levers. The repeatability device is configured to ensure the kinematic repeatability of the movement of the press toggle mechanism, particularly the press toggle column, preferably its toggle levers. The repeatability device corresponds to an auxiliary mechanism ensuring the long-lasting functionality of the press toggle column.

Particularly, the repeatability device is configured to limit the movement range of both toggle levers. Accordingly, the repeatability device ensures that the toggle levers are maintained in a certain range so that they do not loose contact with each other.

According to an embodiment, the repeatability device of the press toggle column comprises at least a first repeatability member assigned to the first toggle lever and a second repeatability member assigned to the second toggle lever. Thus, the repeatability device comprises two separately formed parts that are assigned to the toggle levers. Hence, each toggle lever has its own repeatability member that interacts with the corresponding one of the other toggle lever.

Particularly, the first repeatability members are attached to the first toggle lever, wherein the second repeatability members are attached to the second toggle lever. This facilitates installation and maintenance of the repeatability device, in particular its repeatability members. Moreover, it is ensured that the toggle levers are connected rigidly with the repeatability members.

According to a further embodiment, the repeatability members mesh together. As a result, a steady articulated motion can be ensured.

In an embodiment, the repeatability members may comprise gear-like portions interacting with each other. Due to the several teeth of the gear-like portions that mesh together, a slipping of the contact surfaces of the toggle levers can be prevented effectively.

Particularly, the alignment of the teeth follow the form of the convex-shaped contact surfaces of the toggle levers.

In another embodiment, the repeatability members may comprise a slot and pin guided in the slot, in particular wherein the pin is established by a roller. The slot and the pin guided in the slot prevent a slipping of the convex-shaped contact surfaces of the toggle levers. In fact, the slot and the pin corresponds to a cam mechanism.

For instance, the pin is established by a roller that rolls along the edge of the slot. Thus, the rolling movement of the toggle levers is further supported appropriately.

Optionally, the repeatability device comprises at least one S-shaped repeatability member. The at least one S-shaped repeatability member may operatively connected with both toggle levers simultaneously. Particularly, two S-shaped repeatability members are provided that are operatively connected with both toggle levers, but inversely (mirror-inversed).

In fact, the at least one S-shaped repeatability member is established by a plate that is formed like an S.

Hence, the toggle levers may be assigned to the at least partly circularly shaped reception spaces of the S-shaped repeatability member(s).

Generally, the S-shaped repeatability member may interact with protruding sections of the respective toggle levers, thereby operatively connecting with both toggle levers simultaneously. The protruding sections may protrude laterally.

Particularly, the press toggle column is a platen press toggle column. The platen press toggle column is used in die-cutting machines or stamping machines, for example.

In general, the repeatability device may comprise differently formed repeatability members on the different sides of the press toggle column.

The driving member may be a rotating member that periodically displaces the driven member, in particular in horizontal direction. Furthermore, the driving member may contact continuously and periodically the driven member. This causes a periodical movement of the press toggle column.

Generally, the driving member may be formed by a cam of a camshaft. Alternatively, the driving member is part of a crankshaft or the like, namely the crankpin.

Accordingly, the driving member may relate to a portion of a shaft, for instance a camshaft or a crankshaft, that can be used for interacting with the at least one press toggle column, particularly the driven member.

As mentioned above, the driven member may relate to a cam roller, for instance a separately formed one. Alternatively, the driven member may be a connecting rod, for instance a connecting rod interacting with the crankshaft.

Particularly, the horizontal displacement of the driven member introduced by the driving member is converted into a vertical displacement of at least one of the toggle levers, in particular the one connected to a movable structure.

In a cutting or stamping station with two or more press toggle columns, the at least two driven members of the respective press toggle columns interact with the same driving member.

Alternatively, a separate driving member is assigned to each driven member of the respective press toggle column.

In an embodiment, a first structure assigned to the first toggle lever and a second structure assigned to the second toggle lever are provided, wherein the first structure is a base structure, whereas the second structure is a movable structure. The periodical movement of the press toggle column caused by the driving member leads to an oscillating movement of the assigned movable structure. As mentioned above, the movement direction is converted by the press toggle mechanism.

In particular, the first structure has a first bulge to which the first toggle lever is assigned and/or the second structure has a second bulge to which the second toggle lever is assigned. Preferably, the bulge is established by a convex portion of the respective structure. For instance, the bulge(s) correspond(s) to protrusion(s).

In an embodiment, the bulges are established by two convex parts that are attached to opposite side surfaces of each structure. The convex parts may be formed separately with respect to the structures. Thus, separately formed bulge components may be provided.

A pair of bulges, particularly bulge components, can have a common axis that may be parallel to the y-axis.

The bulges or rather the bulge components may have a circular or semicircular cylindrical shape.

The convex-shaped linkage ends of the corresponding toggle levers and the bulges of the structures assigned to the respective linkage end form movable hinges. As a result, the sliding motion between the linkage end of the toggle lever and the associated structure can be replaced by a (pure) rolling motion or a combined rolling/sliding motion with the above stated advantages.

In a further embodiment, repeatability components are assigned to the interface of the first structure and the first toggle lever and/or to the interface of the second structure and the second toggle lever. The repeatability components are configured to ensure the kinematic repeatability of the movement of the press toggle mechanism, particularly the kinematic repeatability of the movement of the respective lever with the corresponding structure. For instance, the repeatability components and the repeatability members are formed in a similar manner. Hence, the above mentioned advantages with regard to the repeatability members also apply to the repeatability components in a similar manner.

In particular, the repeatability components comprise gear-like portions interacting with each other and/or a slot and a pin guided in the slot, in particular wherein the pin is established by a roller. Due to the teeth of the gear-like portions meshing together, the slot and the pin guided in the slot, a slipping of the contacting convex-shaped ends of the toggle levers can be prevented effectively. When the pin is established by a roller, the pin can roll along the edge of the slot improving the overall rolling movement of the press toggle mechanism.

Figure 2:
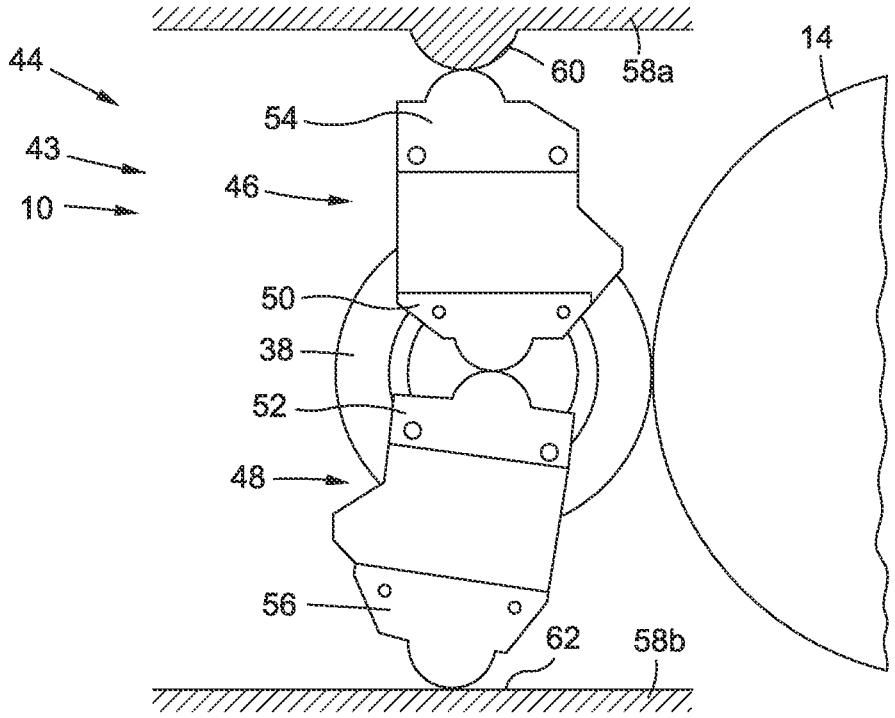
Figure 3:
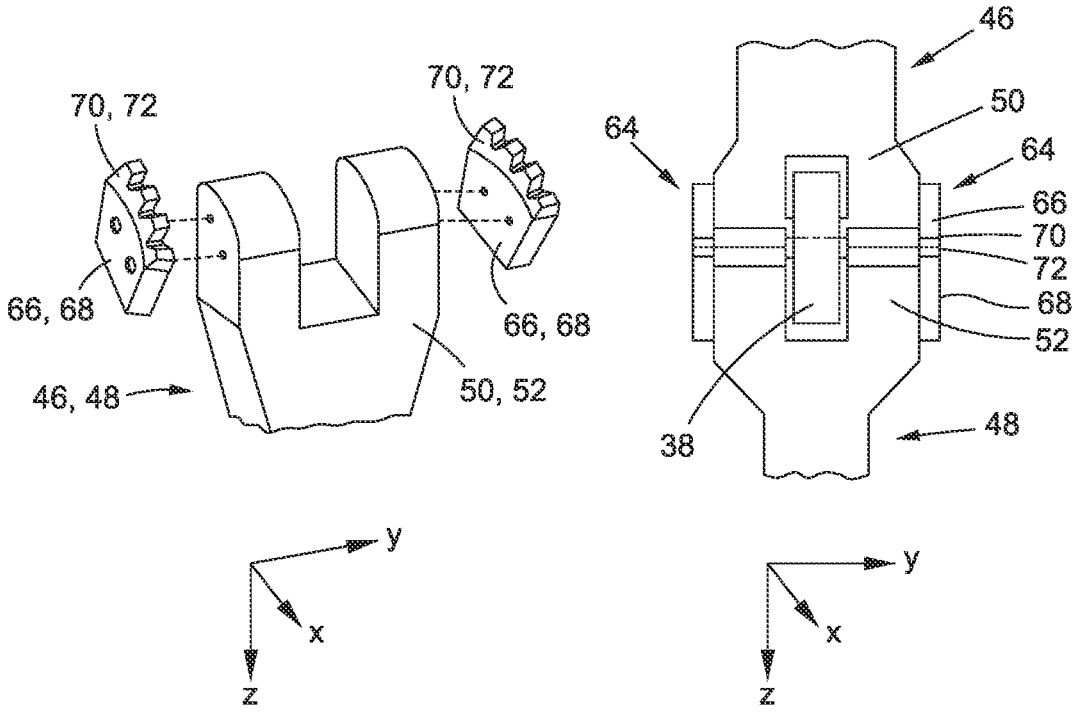
Figure 4:
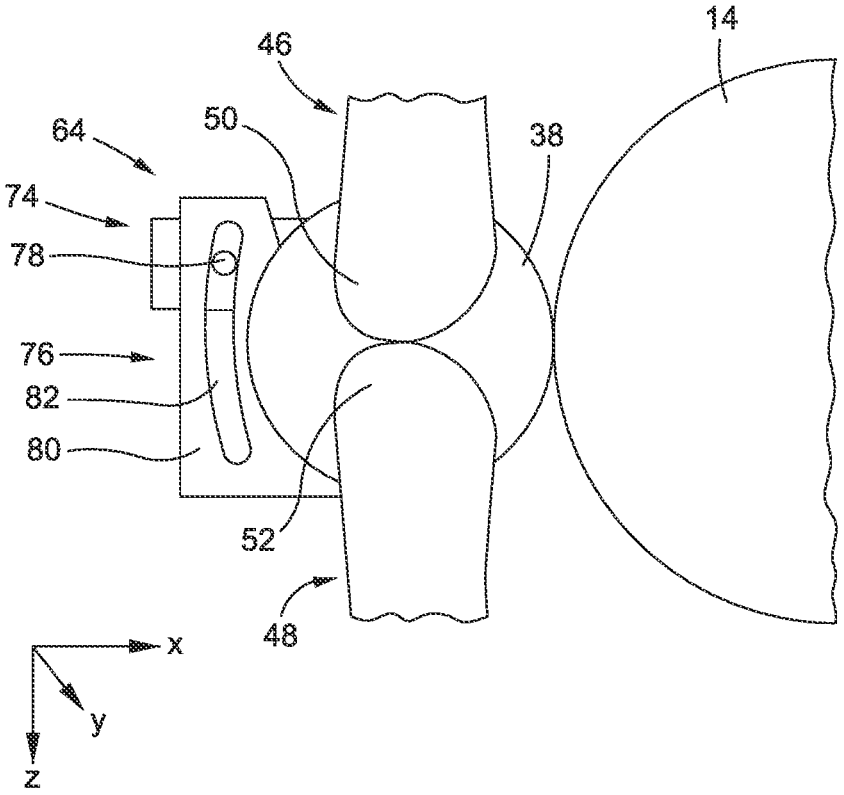
Figure 5:
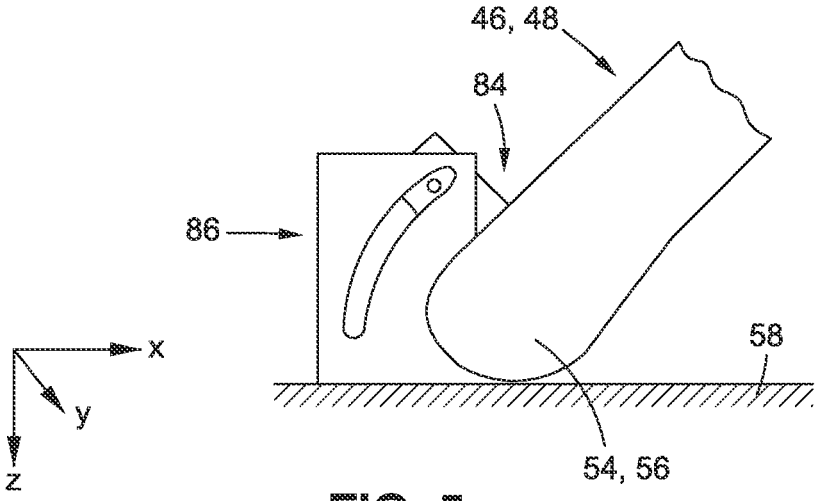
Figure 6:
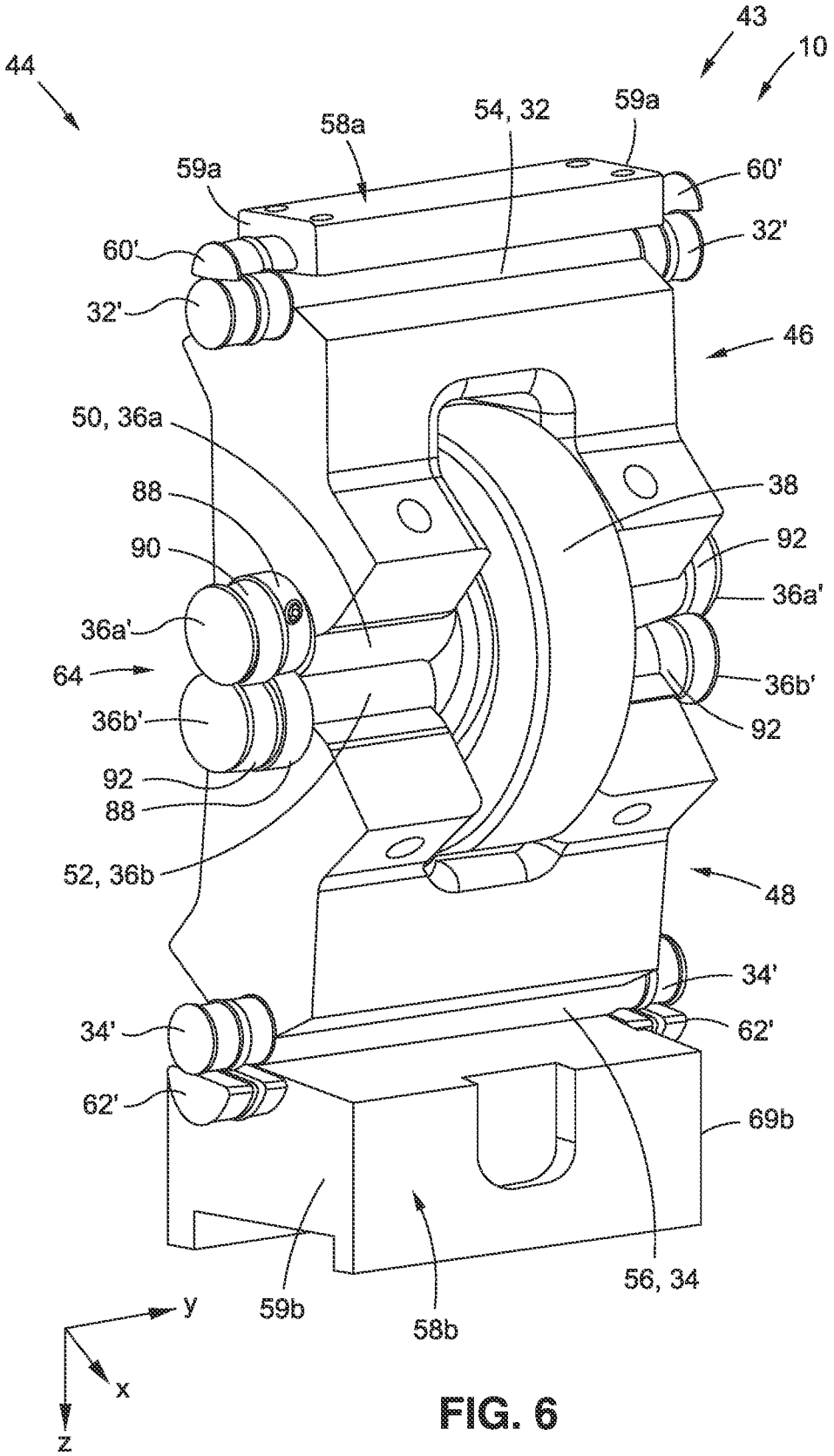
Figure 7:
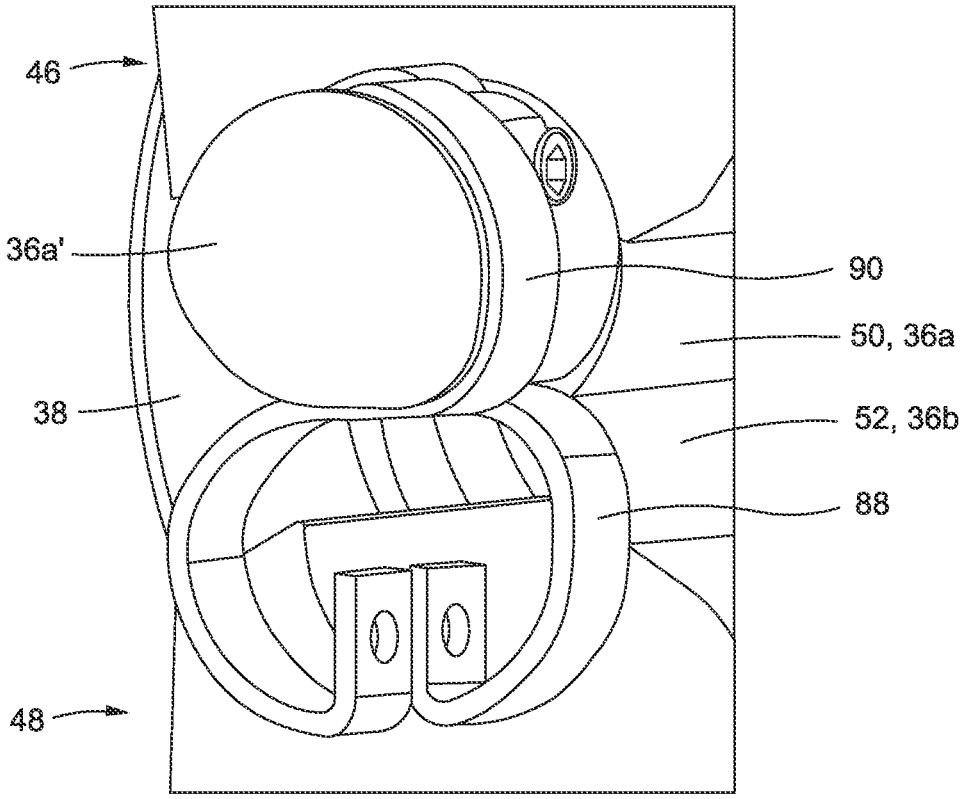

The foregoing aspects and many of the attendant advantages of the claimed subject matter will become more readily appreciated as the same become better understood by reference to the following detailed description, when taken in conjunction with the accompanying drawings, wherein:

FIG. 1 shows a side view of a platen press machine according to the state of the art, FIG. 2 shows a schematic side view of a press toggle mechanism used in a platen press according to the invention comprising a press toggle column, FIG. 3 schematically shows two views on a press toggle column according to an embodiment with a repeatability device according to a first example, FIG. 4 schematically shows a press toggle column according to another embodiment with a repeatability device according to a second example, FIG. 5 schematically shows a detail of a press toggle mechanism used in a platen press according to the invention, FIG. 6 shows a perspective view on a press toggle column of a platen press according to another embodiment with a repeatability device according to a third example, and FIG. 7 a detail view on the repeatability device according to the third example.

FIG. 1 shows a platen press (machine) 10 according to the state of the art, as used in die-cutting or stamping stations, for example.

Generally, such a machine or platen press 10 comprises a moveable structure 12 (e.g. a platen), a driving member 14, several press toggle columns 16 and a (non-movable) base structure 18 (e.g. a pad). In the shown embodiment, the driving member 14 is established by a cam. Alternatively, the driving member 14 may relate to a crankshaft or the like, for instance a crankpin.

The press toggle columns 16 each comprise an upper toggle lever 20 and a lower toggle lever 22 both having an end 24, 26 facing each other, also called contact surface, and a linkage end 28, 30 opposite to the respective contact surface 24, 26.

In the shown embodiment, the contact surfaces 24, 26 and the linkage ends 28, 30 are provided at the integrally formed toggle levers 20, 22. Alternatively, the toggle levers 20, 22 may be formed by more than one part, particularly two parts or three parts, for instance a main body and one or two interface part(s) providing the respective contact surface and/or the linkage end.

As shown in FIG. 1, all ends 24, 26, 28, 30 are provided as concave bearing half shells in the state of the art.

The toggle levers 20, 22 are connected with their respective linkage ends 28, 30 to the movable structure 12 and the base structure 18, respectively, in particular by an upper axle 32 and a lower axle 34.

A center axle 36 connects the respective contact surfaces 24, 26 of the toggle levers 20, 22 and simultaneously supports a driven member 38 that is in continuous contact with the driving member 14. Accordingly, the driving member 14 periodically displaces the contacting press toggle columns 16 in horizontal direction due to its shape. This displacement introduces a periodical movement of the press toggle columns 16 while interacting with the driven member 38 and, thus, the center axle 36.

Alternatively, a separate driving member 14 is assigned to each driven member 38 of the respective press toggle column 16.

Put another way, several driving members 14 are provided, for instance on a crankshaft or a camshaft, which each are assigned to a respective press toggle column 16 in order to interact with the respective driven member 38 of the several press toggle columns 16.

As the driving members 14 are provided by a crankshaft or a camshaft, a synchronized actuation of the respective driven members 14 is ensured.

The periodical movement of the press toggle columns 16 initiated by the horizontal actuation of the driving member 14 causes a vertical oscillating movement of the moveable structure 12, in particular the moveable structure 12 with respect to the base structure 18.

The upper axle 32 is attached to the moveable structure 12 and, further, the upper axle 32 is mounted via its convex joint head in the linkage end 28 of the upper toggle lever 20 in a slidable manner.

The center axle 36 is firmly connected to the contact surface 24 of the upper toggle lever 20 by a screw 40*a*, for instance. Thus, a convex joint head is formed which in turn is mounted in the concave contact surface 26 of the lower toggle lever 22 in a slidable manner.

Similarly, the lower axle 34 is firmly connected to the linkage end 30 of the lower toggle lever 22 by a screw 40*b*, for instance. Thus a convex joint head is formed which is mounted in a concave bearing half shell 42 of the base structure 18 in a slidable manner.

In other words, each of the axles 32, 34, 36 is assigned to convex joint heads interacting with concave components, namely bearing shells.

Accordingly, the convex joint heads of the axles 32, 34, 36 and the respective ends 24, 26, 28, 30 of the toggle levers 20, 22 are in sliding contact with each other and together provide movable hinges.

Due to the sliding motion(s) of the toggle levers 20, 22 and structures 12, 18 in the established slide bearings, the risk of seizure is high.

This risk can be mitigated with a platen press 10 having a press toggle mechanism 43 as well as a press toggle column 44 as described in the following.

The structure of the press toggle mechanism 43 of the platen press 10 as well as the press toggle column 44 is depicted in FIG. 2 in a schematic manner for illustrating the inventive concept.

The driving member 14 periodically displaces the press toggle column 44 via the driven member 38 that is attached to one of the toggle levers 46, 48 resulting in an oscillating movement of at least one connected structure 58, namely the movable structure 58*a* with respect to the (non-movable) base structure 58*b*.

The press toggle column 44 comprises toggle levers 46, 48 each of them having a contact surface 50, 52 and a linkage end 54, 56 opposite to the respective contact surface 50, 52. However, unlike the conventional press toggle column 16 shown in FIG. 1, the contact surfaces 50, 52 of the toggle levers 46, 48 of the press toggle column 44 are convex-shaped.

In other words, the contact surfaces 50, 52 of the toggle levers 46, 48 each have a curvature towards the outside.

In addition, the convex-shaped contact surfaces 50, 52 of the toggle levers 46, 48 directly contact each other.

Hence, no center axle or similar is provided in the contact area or rather contact zone defined by both convex-shaped contact surfaces 50, 52.

Moreover, the linkage ends 54, 56 of the toggle levers 46, 48 are also convex-shaped in the shown embodiment wherein the convex-shaped linkage ends 54, 56 of the toggle levers 46, 48 are in contact with convex bulges 60 of the corresponding structures 58 (e.g. the base structure 58*b* or rather the moveable structure 58*a*).

The convex-shaped contact surfaces 50, 52 as well as the convex-shaped linkage ends 54, 56 together with the convex-shaped bulges 60 of the structures 58 each form movable hinges between the respective components of the press toggle mechanism 43.

Due to the convex shape of the respective parts or rather components, a rolling motion is at least added to the sliding motion of the moveable hinges that occurs in the slide bearings of the conventional press toggle column 16 shown in FIG. 1.

Preferably, the sliding motion of the moveable hinges is replaced by a (substantially) pure rolling motion.

In fact, the convex shape of the respective components or rather parts may yield a combined rolling/sliding motion. Thus, the sliding is reduced which results in a reduced wear or rather seizure.

It should be noted that the linkage ends 54, 56 and/or the bulges 60, 62 of the structures 58 not necessarily need to have a convex shape.

It is also possible that only one of the linkage ends 54, 56 and/or the bulges 60, 62 has a convex shape and the other has a straight shape.

In addition, it is also possible that none of the linkage ends 54, 56 and/or the bulges 60, 62 is convex-shaped.

To ensure the kinematic repeatability of the movement and to transmit the horizontal forces, a repeatability device 64 (see FIGS. 3 and 4) is provided that is operatively connected with both toggle levers 46, 48.

The repeatability device 64 comprises at least a first repeatability member 66, 74 assigned to the first toggle lever 46 (e.g. the upper toggle lever 46) and a second repeatability member 68, 76 assigned to the second toggle lever 48 (e.g. the lower toggle lever 48).

In particular, the repeatability members 66, 68, 74, 76 are attached to the respective toggle levers 46, 48, for example mechanically, particularly by a screw, or with other fixing techniques such as bonding.

FIG. 3 and FIG. 4 illustrate two different embodiments of the repeatability device 64 used by the press toggle mechanism 43 or rather the press toggle column 44.

In FIG. 3, two views on the repeatability device 64 comprising first repeatability members 66 and second repeatability members 68 with gear-like portions 70, 72 are shown.

The repeatability members 66, 68 are arranged parallel to the driven member 38 on a y-axis and attached to the sides of the respective toggle lever 46, 48; please particularly refer to the second view of FIG. 3. The x-axis is orthogonally transverse to a substantially horizontal y-axis that represents a line that is parallel to the rotational axis of the driving member 14 or the driven member 38.

Further, a z-axis is perpendicular to the y-axis and x-axis. The z-axis substantially corresponds to the vertical direction.

The gear-like portions 70, 72 of the repeatability members 66, 68 of the repeatability device 64 are facing to each other wherein the gear-like portions 70, 72 are arranged in a way that they mesh together.

The meshing of the gear-like portions 70, 72 ensures that the (horizontal displacement) forces acting on the driven member 38, which is attached to one of the toggle levers 46, 48, are transmitted without the convex-shaped contacting surfaces 50, 52 of the toggle levers 46, 48 slipping in the direction of the (horizontal displacement) force, namely in x-axis direction.

FIG. 4 depicts a second embodiment of the repeatability device 64 that comprises a first repeatability member 74 and a second repeatability member 76 assigned to the toggle levers 46, 48.

The first and second repeatability member 74, 76 are also arranged parallel to the driven member 38 on the y-axis and attached to one side of the respective toggle lever 46, 48 so that repeatability members 74, 76 mesh together.

It is further conceivable to attach the first and second repeatability members 74, 76 to opposite sides with respect to the contact surfaces 50, 52 of the toggle levers 46, 48 so that the contact surfaces 50, 52 each are centered between two repeatability members 74, 76 assigned to a single toggle lever 46, 48.

In other words, each toggle lever 46, 48 may comprise two repeatability members 74, 76, in particular of the same kind or rather of different kinds, so that the toggle column 44, namely both toggle levers 46, 48, has four repeatability members 74, 76 in total.

In the shown embodiment, the first repeatability member 74 involves a pin 78 and the second repeatability member 76 involves a guide plate 80 with a slot 82.

The pin 78 is guided in the slot 82 of the guide plate 80 ensuring the transmission of the forces acting on the driven member 38, that is attached to one of the toggle levers 46, 48, to the press toggle column 44 without the convex-shaped contacting surfaces 50, 52 of the toggle levers 46, 48 slipping in the direction of the acting force (x-axis).

In order to reduce friction between the pin 78 and the edge of the slot 82, the pin 78 is particularly configured as a roller that may roll along the respective edge of the slot 82. Hence, the (pure) rolling movement of the press toggle mechanism 43 is further improved.

Generally, the repeatability device 64 ensures that the relative movement of the toggle levers 46, 48 are limited.

Moreover, slipping and loss of contact is prevented effectively due to the repeatability device 64.

In such a manner, one or more of the above described repeatability devices 64 can be arranged at the hinges provided by the linkage ends 54, 56 of the respective toggle levers 46, 48 and the respective structures 58, as can be also seen in FIG. 5 in a schematic manner.

In FIG. 5, a first repeatability component 84 is arranged parallel to the driven member 38 on the y-axis and attached to one side of the respective toggle lever 46, 48, namely the linkage end 54, 56 of the respective toggle lever 46, 48.

Further, a second repeatability component 86 is arranged and attached to the structure 58 wherein the respective repeatability components 84, 86 mesh together.

In the present embodiment the repeatability components 84, 86 are formed substantially similar to the repeatability members 74, 76 shown in FIG. 4.

In another embodiment, the repeatability components 84, 86 can also be similar to the repeatability members 66, 68 with the gear-like portions 70, 72 as shown in FIG. 3.

FIG. 5 further reveals that the respective linkage end 54, 56 is convex-shaped whereas the structure 58 is plane without any bulge.

Accordingly, the respective toggle lever 46, 48 rolls along the plane structure 58 via its convex-shaped linkage end 54, 56.

FIG. 6 depicts a further embodiment of the press toggle column 44 using a third embodiment of the repeatability device 64.

Here, the convex contact surfaces 50, 52 and the convex linkage ends 54, 56 of the respective toggle levers 46, 48 are formed—similar to the press toggle column 16 shown in FIG. 1—by circular cylindrical axles 32, 34, 36 firmly connected to the toggle levers 46, 48.

In the embodiment shown in FIG. 6, however, the upper and lower axles 32, 34 are each assigned to the corresponding toggle lever 46, 48 and two center axles 36*a*, 36*b* are provided which are each assigned to one toggle lever 46, 48.

In addition, the axles 32, 34, 36 protrude longitudinally from the press toggle column 44 at their opposite ends, thus forming two protruding sections 32', 34', 36*a*', 36*b*' at each axle 32, 34, 36*a*, 36*b*. The protruding sections 32', 34', 36*a*', 36*b*' may protrude laterally.

In this embodiment, the bulges 60, 62 are formed as lateral protrusions provided by two separately formed bulge components 60' or 62', respectively, that are attached to opposite side surfaces 59 of each structure 58. A pair of bulge components 60' or 62' has a common axis parallel to the y-axis.

In other words, the respective bulge components 60' or 62' each form protruding sections 60' or 62' of the respective structure 58*a*, 58*b*.

The part of the bulges 60, 62 facing the respective linkage end 54, 56 or protruding section 32', 34' of the respective toggle lever 46, 48 can have a straight or convex shape.

Particularly, the bulges 60, 62 or bulge components 60', 62' have at least a semicircular cylindrical shape.

As shown in FIG. 6, the respective interacting protruding sections 36*a*', 36*b*' are assigned to the repeatability device 64.

In this embodiment, the repeatability device 64 comprises several S-shaped repeatability members 88, 90 that are arranged one behind the other along the y-axis direction.

In FIG. 7, the S-shape of the repeatability members 88, 90 becomes more obvious, as the lower protruding section 36*b*' is not shown such that the specific shape of the repeatability members 88, 90 is visible.

In the shown embodiment, two S-shaped repeatability members 88, 90 are provided at the same protruding sections 36*a*', 36*b*'. Thus, the S-shaped repeatability members 88, 90 are operatively connected with both toggle levers 46, 48 simultaneously, but inversely orientated with respect to each other.

In contrast to the above-described embodiments of the repeatability device 64, the repeatability members 88, 90 are each attached to both toggle levers 46, 48 or to both a toggle lever 46, 48 and the assigned structure 58*a*, 58*b*.

Each of the repeatability members 88, 90 is firmly connected to e.g. the protruding section 36*a*' assigned to the first toggle lever 46, for example with a fastener member like a screw. Then, the same repeatability member 88 extends further semicircularly along the circular cylindrical protruding section 36*a*', between the contact surfaces 50, 52 and further semicircularly along the other circular cylindrical protruding section 36*b*' of the second toggle lever 48 to which it is attached (essentially) perpendicularly below the first attachment point. Thus, the S-shape of the repeatability member 88 is obtained.

Put another way, the S-shaped repeatability members 88, 90 each comprise two semicircular reception spaces in which the protruding sections 36*a*', 36*b*' are inserted.

The other repeatability member 90 is also attached to both protruding sections 36*a*', 36*b*' of the toggle levers 46, 48 in the same manner, but mirror-inverted or rather inversely.

Due to the bending stiffness of the repeatability members 88, 90, (substantially) horizontal displacement forces as well as rotational forces of the vertically oscillating toggle levers 46, 48 can be absorbed, thus ensuring the kinematic repeatability of the movement.

Generally and as already discussed above, repeatability components (not shown in FIG. 6) may be provided that are formed similarly with respect to the repeatability members 88, 90 while interacting between the protruding sections 32', 60' or rather the protruding sections 34', 62'.

In each of the protruding sections 32', 34', 36*a*', 36*b*', 60', 62' circumferentially closed recesses 92 are provided in which at least a part of the repeatability members 88, 90 or rather the repeatability components is received.

As a result, the compressive force between the toggle levers 46, 48 is not only transmitted via the repeatability members 88, 90 and/or the repeatability components, but additionally or exclusively via the contact surfaces 50, 52.

Of course, instead of two repeatability members 88, 90 per protruding section 32', 34', **36*a*', 36*b*', 60', 62'**, only one repeatability member or more than two repeatability members may be provided.

In general, the different embodiments described above can be used in combination with each other. Hence, the different embodiments concerning the repeatability device 64 can be combined respectively.

For instance, a single repeatability device 64 may comprise repeatability members 66-76 that mesh together and additionally comprise a slot 82 and a pin (78) guided in the slot 82. Moreover, the single repeatability device 64 may comprise one S-shaped repeatability member 88 on one side of the press toggle column 44 in combination with repeatability members 66-76 that mesh together on the other side of the press toggle column 44.

In a similar manner, the press toggle mechanism may also comprise differently formed repeatability components (84, 86) that are associated with the first structure and the second structure or rather the respective interfaces, namely the interface of the first structure and the first toggle lever or rather the interface of the second structure and the second toggle lever.

While the invention has been illustrated and described in detail in the drawings and foregoing description, such illustration and description are to be considered illustrative or exemplary and non-restrictive. The invention is thus not limited to the disclosed embodiments. Variations to the disclosed embodiments can be understood and effected by those skilled in the art and practicing the claimed invention, from a study of the drawings, the disclosure, and the appended claims.

The invention claimed is:

1. A platen press comprising:

a press toggle mechanism, wherein the press toggle mechanism has a driving member and a press toggle column, the press toggle column comprising:

a driven member, a first toggle lever assigned to the driven member, and a second toggle lever assigned to the driven member, wherein the first toggle lever has a first contact surface with a convex shape and the second toggle lever has a second contact surface with a convex shape, and wherein the convex shape of the first contact surface of the first toggle lever contacts the convex shape of the second contact surface of the second toggle lever to form a movable hinge.

2. The platen press according to claim 1, wherein the first and second toggle levers together form the movable hinge that provides at least a rolling motion between the convex shapes of the first and second contact surfaces.

3. The platen press according to claim 1, wherein the driven member is connected with the first toggle lever.

4. The platen press according to claim 1, wherein each of the first and second toggle levers has a linkage end that is opposite to the respective convex shapes of the first and second contact surfaces.

5. The platen press according to claim 1, further comprising:

a repeatability device that is operatively connected with the first and second toggle levers, wherein the repeatability device is configured to ensure kinematic repeatability of a movement of the first and second toggle levers.

6. The platen press according to claim 5, wherein the repeatability device comprises at least a first repeatability member assigned to the first toggle lever and a second repeatability member assigned to the second toggle lever.

7. The platen press according to claim 6, wherein the first repeatability member is attached to the first toggle lever, and wherein the second repeatability member is attached to the second toggle lever.

8. The platen press according to claim 6, wherein the first and second repeatability members mesh together.

9. The platen press according to claim 6, wherein the first and second repeatability members comprise gear-like portions interacting with each other.

10. The platen press according to claim 6, wherein the first and second repeatability members comprise a slot and a pin guided in the slot.

11. The platen press according to claim 5, wherein the repeatability device comprises at least one S-shaped repeatability member.

12. The platen press according to claim 1, further comprising:

a first structure assigned to the first toggle lever and a second structure assigned to the second toggle lever, wherein the first structure is a base structure, and the second structure is a movable structure.

13. The platen press according to claim 12, wherein repeatability components are assigned to an interface of the first structure and the first toggle lever and/or wherein repeatability components are assigned to the interface of the second structure and the second toggle lever, and wherein the repeatability components are configured to ensure kinematic repeatability of a movement of the press toggle mechanism.

14. The platen press according to claim 13, wherein the repeatability components comprise a slot and a pin guided in the slot, in particular wherein the pin is established by a roller.

15. A press toggle column for a platen press, the press toggle column comprising:

a driven member to be driven by a driving member of the platen press, a first toggle lever to support the driven member and including a first convex surface, and a second toggle lever to support the driven member and including a first convex surface, wherein the first convex surface of the first toggle lever contacts the first convex surface of the second toggle lever to form a movable hinge.

16. The press toggle column of claim 15, wherein the first toggle lever further includes a second convex surface on an opposite end of the first toggle lever from the first convex surface of the first toggle lever.

17. The press toggle column of claim 16, wherein the second toggle lever further includes a second convex surface on an opposite end of the second toggle lever from the first convex surface of the second toggle lever.

18. The press toggle column of claim 15, wherein one or more of the first toggle lever and the second toggle lever further includes a repeatability member to prevent the first convex surface of the first toggle lever from slipping on the first convex surface of the second toggle lever.

19. A press toggle mechanism for a platen press, the press toggle mechanism comprising:

a rotatable driving member; and a press toggle column, the press toggle column comprising:

a rotatable driven member to be rotated by a rotation of the rotatable driving member, a first toggle lever to support the rotatable driven member and including a convex surface, and a second toggle lever to support the rotatable driven member and including a convex surface, wherein the convex surface of the first toggle lever contacts the convex surface of the second toggle lever to form a movable hinge.

20. The press toggle mechanism of claim 19, wherein the rotation of the rotatable driving member causes a periodic displacement of the rotatable driven member in a first direction so that the convex surface of the first toggle lever rolls along the convex surface of the second toggle lever to cause a periodic change in a length of the press toggle column in a second direction transverse to the first direction.

* * * * *